United States Patent [19]

Kleitz et al.

[11] Patent Number: 4,888,134

[45] Date of Patent: Dec. 19, 1989

[54] CONDUCTIVE FOAMS

[75] Inventors: Jean-Pierre Kleitz, Bischwiller; Pierre H. A. Mertzeisen, Kilstett, both of France

[73] Assignee: BASF Aktiengesellschaft, Ludwigshafen, Fed. Rep. of Germany

[21] Appl. No.: 221,050

[22] Filed: Jul. 19, 1988

Related U.S. Application Data

[63] Continuation-in-part of Ser. No. 47,294, May 8, 1987, abandoned.

[30] Foreign Application Priority Data

Jun. 2, 1986 [FR] France ..... 86 07881

[51] Int. Cl.[4] ..... H01B 1/06

[52] U.S. Cl. ..... 252/511; 521/65; 521/70; 252/506; 524/910; 524/911

[58] Field of Search ..... 252/500, 506, 502, 511; 521/65, 67, 70; 524/495, 496, 910, 911

[56] References Cited

U.S. PATENT DOCUMENTS

| | | | |
|---|---|---|---|
| Re. 28,070 | 7/1974 | Brindell et al. . | |
| 3,582,499 | 6/1971 | Rogers et al. | 521/67 |
| 3,728,204 | 4/1973 | Cochran II . | |
| 4,061,811 | 12/1977 | Takase et al. . | |
| 4,231,901 | 11/1980 | Berbeco | 252/511 |
| 4,419,457 | 12/1983 | Tokunaga | 521/67 |
| 4,621,106 | 11/1986 | Fracalossi et al. | 252/511 |

*Primary Examiner*—Josephine Barr

*Attorney, Agent, or Firm*—Bruce E. Harang

[57] ABSTRACT

A conductive foam having a surface resistance of not more than $9.9 \times 10^{10}$ ohms as measured by DIN 53,345 may be prepared by incorporating into the base compound at least about 5 parts by dry weight per 100 parts by weight of polymer of a dispersion of carbon black stabilized by a soap predominantly of the same type as that compatible with the process used to set the foam; and processing the compound in a conventional manner.

12 Claims, No Drawings

CONDUCTIVE FOAMS

The present patent application is continuation in part of U.S. Pat. Application Ser. No. 047,294 filed May 8, 1987 now abandoned.

FIELD OF THE INVENTION

The present invention relates to the manufacture of conductive foams. Foam rubber has a number of applications where it is desirable to eliminate a build up of static electrical charges. These include foam rubber used as vibration and noise dampening material in the electrical industry. One of the most common occurrences of undesirable static electricity is due to domestic and contract floor covering. For domestic purposes current carpets made with an antistatic precoat may be used. In applications requiring a conductive floor covering, a carpet of conductive fiber and backed with a non foam conductive backing may be glued to a conductive foil. However, such a carpet would not have the cushioning effect and feel of a carpet backed with a conductive foam. There is not currently available a carpet backed with a conductive foam having a foam surface resistance of less than $10^8$ ohms as determined by DIN 53,345. There is a need for a conductive foam in these applications.

BACKGROUND OF THE INVENTION

There have been a number of approaches to attempt to increase the conductivity of foam rubber.

U.S. Pat. No. 4,231,901 issued Nov. 4, 1980 to Charleswater Products Inc. teaches impregnating an open celled foam with a composition including a conductive material. The patent teaches impregnating a urethane foam with a compound of a latex of SBR rubber in which carbon black has been dispersed. The art does not suggest that the latex compound could be directly made into a foam. Furthermore, it is not contemplated to use isocyanate compounds in accordance with the present invention.

There are a number of patents which teach the incorporation of conductive foils or fibers into a foam backed carpet. These include U.S. Pat. No. 3,728,204 issued Apr. 17, 1973 to William H. Cochran II, and U.S. Pat. No. 4,061,811 issued Dec. 6, 1977 to Toray Industries. These patents teach the lamination of a foil to a carpet backing or the positioning of conductive fibers in a carpet. These are labour intensive and expensive processes. Neither of these references teach that the foam could be manufactured as a conductive material per se.

U.S. Pat. No. 3,658,774 now Re 28,070 originally issued Apr. 25, 1972 to Uniroyal Inc. teaches the incorporation of a metal salt of an organic acid and a polyol into a polymer to reduce static build up. These materials may be incorporated into styrene-butadiene latices but the patent suggests this latex be used as a primary backing or with a secondary backing such as a jute. There is no clear teaching that the latex could be made into a conductive foam. Furthermore these salts interfere with the process of making gel foam and they make it difficult to dry and cure the foam.

The present invention seeks to overcome the limitations of the prior art.

SUMMARY OF THE INVENTION

The present invention provides a method for the production in the absence of isocyanates of a conductive foam having a surface resistance of not more than $9.9\times10^{10}$ ohms as measured by DIN #53,345, comprising:

(i) preparing a compound comprising per 100 parts by dry weight of an aqueous emulsion of a rubbery polymer emulsified with a soap, up to 150 parts by weight of one more particulate filters, selected from the group consisting of calcium carbonate, clay, talc, dolomite, barytes, aluminum trihydrate and glass microspheres; up to about 8 parts of a vulcanization paste; up to 10 parts by weight of a gelling agent and from 4 to 30 parts by dry weight of an aqueous emulsion containing up to 50 weight percent of carbon black emulsified with a soap;

(ii) mechanically frothing said compound to a density from 80 to 600 g/1;

(iii) forming said frothed compound to a desired shape (iv) gelling said frothed compound, and (v) vulcanizing said frothed compound.

DETAILED DESCRIPTION OF THE INVENTION

The present invention also provides a carpet with an antistatic foam backing.

As used in this specification the term set means the process by which a fluid foam is converted into a non fluid coherent mass. This may occur by a phase inversion as in the gel process or it may occur by evaporating of water as in the no gel process.

The latices useful in accordance with the present invention are latices of rubbery polymers. Generally, these latices have a polymer content from about 40 to 75 percent, preferably from about 60 to 75 percent by weight of the latex. The polymers may be one or more polymers selected from the group consisting of (i) synthetic polymers of up to 50 weight percent of a mixture of one or more monomers selected from the group consisting of $C_{8-12}$ vinyl aromatic monomers which may be unsubstituted or substituted by a $C_{1-4}$ alkyl radical or a chlorine or bromine atom; $C_{1-4}$ alkyl and hydroxy alkyl acrylates; $C_{1-4}$ alkyl and hydroxy alkyl methacrylates; and $C_{2-6}$ alkenyl nitriles; at least 50 weight percent of a $C_{4-6}$ conjugated diolefin, which may be unsubstituted or substituted by a chlorine atom; and optionally up to 10 weight percent of one or more monomers selected from the group consisting of: (a) $C_{3-6}$ ethylenically unsaturated carboxylic acids; (b) amides of $C_{3-6}$ ethylenically unsaturated carboxylic acids, which amides may be unsubstituted or substituted at the nitrogen atom by up to two radicals selected from the group consisting of $C_{1-4}$ alkyl radicals and $C_{1-4}$ hydroxy alkyl radicals; (ii) natural rubber latex; and a mixture of either (i) or (ii) with not more than 20%, preferably less than about 10%, by weight of a latex comprising: at least about 60 percent preferably at least 75 percent by weight of a $C_{8-12}$ vinyl aromatic monomer which may be unsubstituted or substituted or by a $C_{1-4}$ alkyl radical or a chlorine or bromine atom; not more than about 40, preferably not more than 25 percent by weight of a $C_{4-6}$ conjugated diolefin, and from about 0.5 to 5 weight percent of one or more monomers selected from the group consisting of $C_{3-6}$ ethylenically unsaturated carboxylic acids; $C_{3-6}$ ethylenically unsaturated aldehydes; $C_{1-4}$ alkyl or hydroxyl alkyl esters of $C_{3-6}$ ethylenically unsaturated carboxylic acids, and amides of $C_{3-6}$ ethylenically unsaturated carboxylic acids which amides may be unsubstituted or substituted at the nitrogen atom by up to two members of the group consisting of $C_{1-4}$ alkyl and hydroxy alkyl radicals.

Preferably the polymer is a copolymer of styrene and butadiene in a ratio of 20:80 to 40:60. The polymer may also be a reinforced polymer produced by blending, and optionally coagglomerating a soft polymer such as a high butadiene styrene-butadiene latex with a reinforcing resin such as a high styrene, styrene butadiene polymer.

Suitable monomers are well known in the art. The vinyl aromatic monomers include styrene and alpha methyl styrene and their homologues. Suitable acrylates include methyl acrylate, methyl methacrylate, ethyl acrylate, hydroxyethyl acrylate, ethyl methacrylate, hydroxy ethyl methacrylate, and their homologues. The most common nitrile is acrylonitrile. Copolymerizable ethylenically unsaturated carboxylic acids include acrylic, methacrylic, itaconic and fumaric acids. Lower alkyl esters of those acids may also be present in the functional polymers. The functional polymer may also include aldehydes such as acrolein or amides of the above noted acids such as acrylamide, methyacrylamide and N-methylol acrylamide.

These latices may be compounded in a conventional manner for the manufacture of foam rubber. Generally the compound may contain up to about 500, preferably less than about 250 parts by weight of a particulate filler either organic or inorganic. Suitable fillers include calcium carbonate, clay, talc, dolomite, barytes, aluminum trihydrate, silicates, glass microspheres, rubber crumb and other suitable fillers. If a gelling agent is used usually lower amounts of filler are present, generally not more than about 170 parts by weight per 100 parts by weight of polymer, most preferably less than about 150 parts by weight of fill per 100 parts by weight of polymer. The compounds generally contain curing agents in amounts well known in the art and other conventional additives.

The compound may contain a gelling agent or a gelling agent may be added later during processing. The gelling agents operate by converting the soap or part of the soap which stabilizes the compound into an insoluble material. The amount of gelling agent will depend on the compound formulation. Several types of gelling agents are known in the art of making foam rubber. The two most common systems are alkali metal silicofluorides and systems which are a combination of an ammonia or an ammonium ion releasing compound and a compound which releases a zinc or a cadmium ion. The silicofluorides are usually used as aqueous dispersions in amounts corresponding to up to about 2, generally 1 to about 1.5 parts by dry weight per 100 parts by weight of compound (wet). The ammonia-metal gel systems are used in amounts so that the zinc or cadmium ion is present in an amount from about 0.5 to 10, preferably 1 to 5 parts by weight per 100 parts by weight of polymer. The ammonium releasing compound and their use are well known in the art such as described in High Polymer Latices by D. C. Blackley, Maclaren and Sons Ltd., 1979, Vol. 1 page 35 to 43. Typically the ammonium releasing compound is used in amounts to provide from about 0.1 up to about 4, preferably 0.3 to 2 parts of ammonia per 100 parts of rubbery polymer as disclosed in U.S. Pat. No. 3,904,558 issued Sept. 9, 1975 to Polysar Limited.

The preferred alkali metal silicofluorides are sodium and potassium silicofluoride. For the ammonia metal ion gelling systems the preferred metal ion is zinc, which is usually present in the compound as part of the cure paste. Typical ammonium ion releasing compounds include ammonium salts of acids such as ammonium acetate, ammonium chloride and ammonium sulphate.

The above gelling agents, and particularly sodium silicofluoride, may be used in conjuction with agents to improve processing and foam characteristics. Typically such agents include ammonium sulphamate; ammonium sulfate; $C_{1-4}$ amine sulphamates, and $C_{1-4}$ amine sulphates. These agents may be used in amounts up to about 3 parts by weight per 100 parts by weight of polymer. Preferably the agent is used in amounts from about 0.15 to about 0.6 parts by weight per 100 parts by weight of polymer.

There are several types of carbon black or graphite which are useful in making materials having antistatic properties. These include the acetylene blacks, channel blacks, conductive furnace blacks, and super conductive furnace blacks. The black may be purchased in powder form or in the form of a dispersion. If the compound contains sufficient soap the carbon black might be added directly to the compound. Generally when compounding with a latex, carbon black is easier to handle as an aqueous dispersion. If the carbon black is used as an aqueous dispersion it should preferably be prepared with a soap or soap system of predominantly the same type as the soap used to make the compound. It is possible to use a soap system consisting of a major amount of the compounding soap and a minor amount of a different type of emulsifier. Typical compounding soaps for gel systems are soaps of $C_{8-20}$ saturated and unsaturated acids, rosin acid, hydrogenated rosin acid or a mixture thereof. Preferred soaps are ammonium or alkali metal soaps of oleic, palmitic or rosin acid. For non gel systems compounding soaps may include synthetic emulsifiers. Typical emulsifiers include sulfosuccinamates, alkyl sulfates and alkyl sulfonates. Preferably the emulsifiers are in the form of alkali salts or ammonium salts.

Useful dispersions will contain up to about 50 preferably about 15 to 35 weight percent carbon black and the above specified soaps and water. The carbon black dispersion may be prepared by suitable means such as a ball mill or high shear agitator or other suitable mixing equipment. In preparing the dispersion care should be taken to insure that agglomerates of carbon black are broken down so that a uniform dispersion of small particle size is obtained. In preparing the carbon black dispersion the soap is preferably used as a solution with from about 10 to 50 preferably about 15 to 45 percent soap and the balance water. The viscosity of the carbon black dispersion may be lowered by incorporating up to about 100 parts by weight of a paraffin wax emulsion per 100 parts by weight of carbon black solids. Suitable paraffin wax emulsions may be purchased under the trade name Mobilcer.

The upper limit of carbon black is functional. That is it may be added until it reduces the quality of the foam, or the foam becomes uneconomic. The amount of carbon black required will vary depending on the type and quality of carbon black. Generally the carbon black is used in an amount from about 4 to about 30, preferably 6 to 15 parts by weight per 100 parts by weight of polymer. The efficiency of the carbon black depends on its type and particle size. Smaller particle size carbon blacks tend to be more effective. The efficiency of the carbon black is believed to depend on volume of carbon black in the compound. The foam should contain a sufficient amount of carbon black to provide a foam surface resistance of not more than $9.9\times10^{10}$ ohms as determined by German DIN 53,345.

The compound will contain a vulcanization system and, where required, vulcanization accelerators. Typically, these systems are compounded together, optionally with antioxidants and prepared as aqueous dispersions or pastes. Hence, the name cure paste or vulcanization paste. Typically, the systems contain sulfur and a bivalent metal in such as zinc or cadmium, preferably zinc. The cure pastes incorporate one or more accelerators such as dithiocarbamate or a thiazole. In some cases the cure paste may include one or more antioxidants such as polymeric hindered phenols or the reaction product of diphenyl amine-acetone. The cure paste comprises at least 50 weight percent solids. A representative cure paste comprises on a dry weight basis:

| | |
|---|---|
| Sulphur | 1.65 grams |
| Zincoxide | 1.25 grams |
| Zinc diethyl dithiocarbamate | 1.00 gram |
| zinc salt of mercaptobenzothiazole | 1.25 grams |
| reaction product of diphenylamine and acetone | 0.45 grams |
| polymeric hindered phenol | 0.30 grams |
| | 5.90 grams |

The cure paste is prepared at about 52% solids.

The compound is prepared in a usual manner, frothed, and when present the gelling agent is added as the last ingredient just before, during or after frothing. Generally the frothed compound will have a density from about 80 to 600 g/1. The frothed compound is then molded or applied to a substrate such as the back of a carpet, textile, non woven, cloth, paper or a release substrate and gelled, dried and cured in accordance with good practice in the industry. Generally gelling is brought about by heating under infrared fields or any other suitable gelling method. Gel foams may be compressed or embossed with various patterns after gelling. Drying and curing are usually carried out in a forced air drier at temperatures from about 100° C. to about 200° C. from 2 to 15 minutes.

These gelling and drying conditions are dependent on the equipment, the density of the foam, the thickness of foam and the solids content of the foam. Drying conditions will have to be determined for each particular situation.

EXAMPLES

The following examples are intended to illustrate the invention and are not intended to limit the invention. In the examples, unless otherwise specified parts are parts by dry weight and in grams.

Example I

Two dispersions of carbon black were prepared on a high shear mixer with the following formulations.

| | Formula I | II |
|---|---|---|
| Water | 150 g | 150 g |
| Potassium Oleate | — | — |
| (18% solution) | 220 g | 220 g |
| Dispersant (sodium salt of napthalene methane sulfonic acid) | — | 30 g |
| Carbon black | 180 g | 180 g |

The carbon black was furnace black and sold under the trade name Corax L. The final pH of the dispersion was 11. Two compounds were prepared with the following formulation.

| | Dry | Wet |
|---|---|---|
| SBR latex sold as POLYSAR Latex 2341 | 100 g | 150 g |
| Carbon Black (Formula I or II) | 22 g | 55 g |
| Cure paste (as disclosed at page 9) | 7.6 g | 13 g |
| Filler ($CaCO_3$) | 80 g | 80 g |

The solids of the compound was 70 percent by weight and the viscosity of the compound was adjusted to about 3,000 cps with a sodium polyacrylate thickener. The compound was foamed to 300 g/1, to the foam were added from 9 parts to 15 parts by wet weight of a solution comprising 15 parts by wet weight of ammonium acetate, 5 parts ammonia as 27 percent solution and 80 parts of water. After adequate blending this foam was applied to a precoated tufted carpet. The foam was gelled for 1 minute under infrared heaters and subsequently dried and cured in a forced air oven at 150° C. The foam was applied at a coat weight of about 900 g (wet)/$m^2$. The experiments were carried out after the carbon black dispersion was made, at 1 week and 2 weeks after preparation of the carbon black dispersion. In all cases for gelling agent levels of 9 to 13 parts the foams were judged satisfactory and showed a smooth crack free surface. Under gelling occurred at less than 9 parts of gelling agent and over gelling occurred at over 13 parts of gelling agent. The concepts of under gelling and over gelling are well known in the industry.

The delamination strength of the carpet was tested. At 80 parts of filler the delamination strength was 15 newtons/5 cm (width). At 60 parts of filler the delamination strength was 22 newtons per 5 cm width. These values are considered suitable in the art. The foam surface resistance ($R_{OT}$) and the through carpet resistance ($R_{DT}$) of the carpet were measured according to DIN 53,3 The carpet was conductive with a resistance less than $10^8$ ohms.

Example II

Using the above formulations a series of foamed backed carpets were prepared containing various amounts of carbon black. The amount of potassium oleate was adjusted in the compound to remain constant at 4 parts by dry weight per 100 parts by dry weight of polymer. The carpet had conductive fiber (yarn) and was precoated with an antistatic precoat. The carpet samples were satisfactory in surface appearance and delamination strength. The surface resistance ($R_{OT}$) and the resistance through the carpet were measured according to DIN 53,345 Part I. The results are recorded in Table II.

It was also found that the through-the-carpet resistance does not significantly increase if a standard (non conductive) precoat is used, which can offer an economic advantage and overcomes difficulties often associated with conductive precoats including the plasticizing effect of antistatic additives; poor water spotting resistance., slower drying and carbon black resurgency.

TABLE II

| Amount of Carbon Black (parts by dry weight per 100 parts of polymer DIN 53,345) | Surface Resistance of the foam ($R_{OT}$) (ohms) | Through Carpet Resistance ($R_{DT}$) (ohms) |
|---|---|---|
| 4 | $10^{14}$ | $6 \times 10^{12}$ |
| 6 | $8 \times 10^{8}$ | $5 \times 10^{8}$ |
| 7 | $6 \times 10^{6}$ | $7 \times 10^{6}$ |
| 8 | $10^{7}$ | $7 \times 10^{6}$ |
| 10 | $3 \times 10^{5}$ | $2 \times 10^{5}$ |

It is generally accepted in the carpet industry that a carpet having a surface ($R_{OT}$) or through carpet resistance of less than about $10^8$ conductive. Thus about 6 to 7 parts by dry weight of carbon black are required per 100 parts of polymer gives a conductive foam in this formulation.

Example III

A further carbon black dispersion was prepared with the following formulation.

| Carbon Black Dispersion | Dry | Wet |
|---|---|---|
| Water | — | 80 g |
| Potassium Oleate | 40 g | 200 g |
| Dispersant (sodium salt of Napthalene methane sulfonic acid | 15 g | 33.3 g |
| Carbon Black (Corax L) | 100 g | 100 g |
| | 155 g | 413.3 g |

A basic compound was prepared as using the following formulation:

| | Dry | Wet |
|---|---|---|
| SBR Latex (POLYSAR Latex 2341) | 100 g | 150 g |
| Carbon Black Dispersion (above) | 15.5 g | 41.3 g |
| Cure paste (as disclosed at page 9) | 7.6 g | 13 g |
| Silicone SM 2064 emulsion (silicone) | 0.2 g | 0.4 g |
| Calcium Carbonate | 80 g | 80 g |

The compound was thickened to 2500 cps. The compound contained 10 parts carbon black per 100 parts by weight of polymer. The compound was foamed to 300 g/1 and an ammonium acetate/ammonia gelling system was added to the compound as described in Example I. The frothed compound was applied to a precoated conductive carpet at a coat weight of about 900 g (wet)/m$^2$ on a pilot coater and dried. The resulting carpet had an acceptable backing and through the carpet, carpet surface and foam surface resistances of less than $10^8$ ohms as measured by DIN 53,345.

Example IV

A carbon black dispersion having the following composition was prepared :

| | Dry | Wet |
|---|---|---|
| Water | — | 109 g |
| Potassium Oleate | 20 g | 100 g |
| Dispersant Per Example I | 5 g | 11.1 g |
| Carbon Black | 80 g | 80 g |
| | 105 g | 300.1 g |

A compound having the following composition was prepared:

| | Dry | Wet |
|---|---|---|
| SBR Latex (POLYSAR Latex 2339) | 100 g | 150 g |
| Above carbon black dispersion | 10.5 g | 30 g |
| Cure Paste (as described at page 9) | 6.5 g | 10.6 g |
| Silicone Emulsion SM 2064 | 0.2 g | 0.4 g |
| Ammonium Sulfamate | 0.9 g | 1.85 g |
| Calcium Carbonate | 30 | 30 |

The compound was thickened with a polyacrylate thickener to 2500 cps. The compound was foamed to 300 g/1 and 5 ml of a 30 percent active dispersion of sodium silicofluoride was added per 100 g of wet compound. The foam was applied to the back of a carpet sample at a coat weight of about 900 g (wet)/m$^2$ and gelled under infrared heaters for about 1 minute. The foam was then dried and cured. This gives an acceptable foam with a few very fine cracks. The above procedure was repeated except that the foam was gelled in a steam cabinet. This gave an excellent foam.

The samples prepared had through the carpet, carpet surface, and foam surface resistances, as measured by DIN 53,345 of less than $10^8$ ohms.

Example V

A carbon black dispersion of the following composition was prepared:

| | Dry | Wet |
|---|---|---|
| Water | — | 225.5 g |
| Sodium Sulfosuccinamate | 80 g | 230 g |
| Dispersant (per Example I) | 20 g | 44.5 g |
| Carbon Black | 150 g | 150 g |
| | 250 g | 650 g |

A compound of the following formulation was prepared:

| | Dry | Wet |
|---|---|---|
| SBR Latex POLYSAR Latex 2341 | 100 g | 150 g |
| Carbon Black Dispersion (as above but containing a wax emulsion (Mobilcer RV)) | 25 g | 65 g |
| Cure Paste (as described at page 9) | 11.5 g | 24.8 g |
| Calcium Carbonate | 120 g | 120.0 g |
| | 256.5 g | 359.8 g |

The compound was thickened with a polyacrylate thickener to 2800 cps. The compound was then foamed to 300 g/1. A sample of the foam was drawn down on the back of a carpet at a coat weight of about 900 g (wet)/m$^2$ and set under infrared heaters for one minute, then dried and cured. The resulting foam had an excellent quality. The carpet had a through the carpet, carpet surface and foam surface resistances of less than $10^8$ ohms when measured by DIN 53,345.

What is claimed is:

1. A method for the production in the absence of isocyanates of a conductive foam having a surface resistance of not more than $9.9 \times 10^{10}$ ohms as measured by DIN #53,345, comprising:

(i) preparing a compound comprising per 100 parts by dry weight of an aqueous emulsion of a rubbery polymer emulsified with a soap, up to 150 parts by weight of one or more particulate filters, selected from the group consisting of calcium carbonate, clay, talc, dolomite, barytes, aluminum trihydrate and glass microspheres; up to about 8 parts of a vulcanization paste; up to 10 parts by weight of a gelling agent and from 4 to 30 parts by dry weight of an aqueous emulsion containing up to 50 weight percent of carbon black emulsified with a soap;

(ii) mechanically frothing said compound to a density from 80 to 600 g/1;

(iii) forming said frothed compound to a desired shape;

(iv) gelling said frothed compound; and (v) vulcanizing said frothed compound.

2. A process according to claim 1 wherein said aqueous emulsion of a rubbery polymer contains from about 40 to about 75 weight percent of one or more rubbery polymers selected from the group consisting of:

(i) synthetic polymers comprising up to 50 weight percent of one or more monomers selected from the group consisting of $C_{8-12}$ vinyl aromatic monomers which may be unsubstituted or substituted by a $C_{1-4}$ alkyl radical or a chlorine or bromine atom; $C_{1-4}$ alkyl and hydroxy alkyl acrylates; $C_{1-4}$ alkyl and hydroxy alkyl methacrylates, and $C_{2-6}$ alkenyl nitriles; and at least 50 weight percent of a $C_{4-6}$ conjugated diolefin which may be unsubstituted or substituted by a chlorine atom;

(ii) natural rubber;

(iii a mixture of (i) or (ii) with not more than 20 weight percent of a polymer comprising not less than 60 weight percent of a $C_{8-12}$ vinyl aromatic monomer which may be unsubstituted or substituted by a $C_{1-4}$ alkyl radical or a chlorine or bromine atom., not more than 40 weight percent of a $C_{4-6}$ conjugated diolefin; and from 0.5 to 5 weight percent of one or more monomers selected from the group consisting of $C_{3-6}$ ethylenically unsaturated carboxylic acids; $C_{3-6}$ ethylenically unsaturated aldehydes; $C_{1-4}$ alkyl or hydroxy alkyl esters of $C_{3-6}$ ethylenically unsaturated carboxylic acids and amides of $C_{3-6}$ ethylenically unsaturated carboxylic acids which amides may be unsubstituted or substituted at the nitrogen atom by up to two members selected from the group consisting of $C_{1-4}$ alkyl and $C_{1-4}$ hydroxy alkyl radicals.

3. A process according to claim 2 wherein said soap is selected from the group consisting soaps of $C_{8-20}$ saturated and unsaturated carboxylic acids and rosin acids..

4. A process according to claim 3 wherein said gelling agent is an alkali metal salt of silicofluoride and is present in an amount from 1 to 2 parts by weight.

5. A process according to claim 3 wherein said gelling agent is an admixture comprising: 0.1 to 4 parts by weight of ammonia or an ammonia releasing compound in the presence of up to 10 parts by weight of a zinc or cadmium ion.

6. A process according to claim 4 wherein said compound further comprises up to 3 parts by weight of a compound selected from the group consisting of ammonium sulphamate, ammonium sulphate, $C_{1-4}$ amine sulphamates and $C_{1-4}$ amine sulfates.

7. A process according to claim 5 wherein said compound further comprises up to 3 parts by weight of a compound selected from the group consisting of ammonium sulphamate, ammonium sulphate, $C_{1-4}$ amine sulphamates and $C_{1-4}$ amine sulfates.

8. A process according to claim 6 wherein said rubbery polymer is a copolymer of styrene and butadiene in a weight ratio from 20:80 to 40:60.

9. A process according to claim 7 wherein said rubbery polymer is a copolymer of styrene and butadiene in a weight ratio from 20:80 to 40:60.

10. A method for the production of a conductive foam having a surface resistance of not more than $9.9\times10^{10}$ ohms as measured by DIN #53,345 comprising:

(i) preparing a compound comprising per 100 parts by dry weight of an aqueous emulsion of a rubbery polymer emulsified with one or more synthetic emulsifiers selected from the group consisting of sulfosuccinamates, alkyl sulfates and alkyl sulfonates, up to 250 parts by weight of one or more particulate fillers selected from the group calcium carbonate, clay, talc, dolomite, barytes, aluminum trihydrate, and glass microspheres; up to 8 parts of a vulcanization paste and from 4 to 30 parts by dry weight of an aqueous emulsion of carbon black emulsified with one or more synthetic emulsifiers selected from the group consisting of sulfosuccinamate, $C_{8-20}$ alkyl sulfates, and $C_{8-20}$ alkyl sulfonates which contains up to 50 weight percent of carbon black;

(ii) frothing said compound to a density from 80 to 600 g/1;

(iii) spreading said compound over a substrate;

(iv) setting said frothed compound, and (v) vulcanizing said frothed compound.

11. A process according to claim 10 wherein said aqueous emulsion of a rubbery polymer contains from about 40 to about 75 weight percent of one or more rubbery polymers selected from the group consisting of:

(i) synthetic polymers of up to 50 weight percent of one or more monomers selected from the group consisting of $C_{8-12}$ vinyl aromatic monomers which may be unsubstituted or substituted by a $C_{1-4}$ alkyl radical or a chlorine or bromine atom; $C_{1-4}$ alkyl and hydroxy alkyl acrylates; $C_{1-4}$ alkyl and hydroxy alkyl methacrylates, and $C_{2-6}$ alkenyl nitriles; at least 50 weight percent of a $C_{4-6}$ conjugated diolefin which may be unsubstituted or substituted by a chlorine atom;

(ii) natural rubber;

(iii) a mixture of (i) or (ii) with not more than 20 weight percent of a polymer of not less than 60 weight percent of a $C_{8-12}$ vinyl aromatic monomer which may be unsubstituted or substituted by a $C_{1-4}$ alkyl radical or a chlorine or bromine atom, not more than 40 weight percent of a $C_{4-6}$ conjugated diolefin; and from 0.5 to 5 weight percent of one or more monomers selected from the group consisting of $C_{3-6}$ ethylenically unsaturated carboxylic acids; $C_{3-6}$ ethylenically unsaturated aldehydes; $C_{1-4}$ alkyl or hydroxy alkyl esters of $C_{3-6}$ ethylenically unsaturated carboxylic acids and amides of $C_{3-6}$ ethylenically unsaturated carboxylic acids which amides may be unsubstituted or substituted at the nitrogen atom by up to two members selected from the group consisting of $C_{1-4}$ alkyl and $C_{1-4}$ hydroxy alkyl radicals.

12. A process according to claim 10 wherein said rubbery polymer is a copolymer of styrene and butadiene in a weight ratio from 20:80 to 40:60.

* * * * *